US010280568B2

(12) United States Patent
McDonald

(10) Patent No.: US 10,280,568 B2
(45) Date of Patent: May 7, 2019

(54) FIELD-ASSEMBLY CONCRETE DOWEL BASKET

(71) Applicant: Stephen F. McDonald, Hertford, NC (US)

(72) Inventor: Stephen F. McDonald, Hertford, NC (US)

(73) Assignee: McTech Group, LLC, Hertford, NC (US)

( * ) Notice: Subject to any disclaimer, the term of this patent is extended or adjusted under 35 U.S.C. 154(b) by 7 days.

(21) Appl. No.: 15/399,892

(22) Filed: Jan. 6, 2017

(65) Prior Publication Data

US 2018/0195240 A1 Jul. 12, 2018

(51) Int. Cl.

| | |
|---|---|
| ***E01C 11/14*** | (2006.01) |
| ***E01C 23/04*** | (2006.01) |
| ***E01C 19/50*** | (2006.01) |
| *E01C 11/06* | (2006.01) |

(52) U.S. Cl.

CPC ..... *E01C 11/14* (2013.01); *E01C 19/504* (2013.01); *E01C 23/04* (2013.01); *E01C 23/045* (2013.01); *E01C 11/06* (2013.01)

(58) Field of Classification Search

CPC ..... E01C 11/14
USPC ..... 404/51, 52, 56, 60; 52/396.02
See application file for complete search history.

(56) References Cited

U.S. PATENT DOCUMENTS 2,133,553 A * 10/1938 Lord ..... E01C 11/14 404/135
2,265,301 A * 12/1941 Meyer ..... E01C 11/02 404/47
2,267,024 A * 12/1941 Godwin ..... E01C 11/12 404/58
2,291,157 A * 7/1942 Hillberg ..... E01C 11/14 404/136
2,323,026 A * 6/1943 Geyer ..... E01C 11/14 404/48
2,375,361 A * 5/1945 Hillberg ..... E01C 11/14 404/136
2,401,964 A * 6/1946 Robertson ..... E01C 23/045 404/88
2,439,428 A * 4/1948 Hillberg ..... E01C 11/14 404/136

(Continued)

*Primary Examiner* — Thomas B Will
*Assistant Examiner* — Katherine J Chu
(74) *Attorney, Agent, or Firm* — Mehrman Law Office; Michael J. Mehrman

(57) ABSTRACT

A field-assembly dowel basket for concrete construction configured for in-the-field assembly from standardized components. This allows a number of standard components, including clips, connectors and wire frame components, to be conveniently transported and stored on construction sites to facilitate on-site assembly of dowel baskets on an as-needed, where-needed basis. Since the dowel basket components are much smaller than assembled baskets, they can be shipped and stored much more cost effectively. Standardization of components allows mass production, consolidates inventory management, and avoids the need for ad hoc fabrication for each construction site. On-site fabrication largely eliminates welding from the dowel basket fabrication process (wire frame clips may involve welding), avoids shipping of fabricated dowel baskets, and allows assembly of dowel basket by construction workers as opposed to highly skilled welding shops.

19 Claims, 10 Drawing Sheets

(56) References Cited

U.S. PATENT DOCUMENTS

| | | | | | |
|---|---|---|---|---|---|
| 2,489,851 | A * | 11/1949 | Bean | E01C 19/504 | 249/83 |
| 2,780,149 | A * | 2/1957 | Heltzel | E01C 11/14 | 404/57 |
| 2,848,929 | A * | 8/1958 | Wilbur | E01C 11/14 | 249/9 |
| 3,870,428 | A * | 3/1975 | Jackson | E01C 11/14 | 248/301 |
| 3,972,640 | A * | 8/1976 | Miller | E01C 11/14 | 404/62 |
| 4,648,739 | A * | 3/1987 | Thomsen | E01C 11/227 | 404/2 |
| 5,797,231 | A * | 8/1998 | Kramer | E04B 1/483 | 404/52 |
| 6,092,960 | A * | 7/2000 | McCallion | E01C 11/14 | 404/62 |
| 6,477,203 | B1 * | 11/2002 | Poplin | G06F 17/16 | 375/240.2 |
| 7,481,031 | B2 * | 1/2009 | Boxall | E01C 11/14 | 404/57 |
| 8,381,470 | B2 * | 2/2013 | Boxall | E01C 11/14 | 404/57 |
| 8,511,935 | B1 * | 8/2013 | Thomas | E01C 11/14 | 404/135 |
| 10,119,281 | B2 * | 11/2018 | Connell | E04B 5/36 | |
| 2007/0231068 | A1 * | 10/2007 | Francies | E01C 11/14 | 404/56 |

* cited by examiner

FIELD-ASSEMBLY CONCRETE DOWEL BASKET

TECHNICAL FIELD

The present invention relates to concrete dowel devices suitable for road construction and, more particularly, to a field-assembly dowel basket assembled from standardized components on an as-needed, where-needed basis.

BACKGROUND

Concrete dowels are embedded into joints between adjacent slabs of concrete to prevent vertical displacement between the slabs to maintain a smooth pavement surface and increase the strength of the concrete in the region of the joint. While the dowels are provided to prevent excessive vertical displacement between the slabs, they may be designed to allow a small amount of horizontal separation and lateral displacement between the slabs to relieve internal stress to accommodate drying shrinkage and thermal expansion and contraction of the slabs. This permits a normal amount of slab movement to prevent excessive cracking while still maintaining a smooth top surface of the pavement. In road construction, a series of dowels is typically installed at each expansion joint between adjacent sections or slabs of pavement.

In concrete road construction, a long structure known as a dowel basket is often used to hold a line of dowels in place at the edge of a section of pavement before the slab is poured. The basket positions each dowel so that half of the dowels will be embedded in the concrete slab to be poured, with the other half to be embedded in the adjacent slab to be poured next. An expansion joint is typically formed into the joint or cut into the dried concrete above the dowel basket at each expansion joint. The road is thus constructed section after section, and mile after mile, with a line of dowels held in place by a dowel basket embedded into the concrete at each expansion joint.

Constructing a road in this manner requires the dowel baskets to be continually constructed and made available at the construction site as section after section, and mile after mile, of road is poured. In conventional road construction, the dowel baskets are welded together at a welding shop and then transported, typically by truck, to the construction site. For a long road construction project, a series of welding jobbers may be contracted along the route as the road is constructed. Dowel basket fabrication can be a significant logistical challenge and a major cost factor in road construction. At times, dowel basket fabrication may become the critical path item, causing the construction crew to sit idle waiting on dowel basket delivery before road construction project can continue. As a result, there is a persistent need for cost effective solution to dowel basket manufacturing to facilitate concrete road construction.

SUMMARY

The present invention meets the needs described above in a field-assembly dowel basket for concrete construction configured for in-the-field assembly from standardized components. This allows a number of standard components, including clips, connectors and wire frame components, to be conveniently transported and stored on construction sites to facilitate on-site assembly of dowel baskets on an as-needed, where-needed basis. Since the dowel basket components are much smaller than assembled baskets, they can be shipped and stored much more cost effectively. Standardization of components allows mass production, consolidates inventory management, and avoids the need for ad hoc fabrication for each construction site. On-site fabrication largely eliminates welding from the dowel basket fabrication process (wire frame clips may involve welding), avoids shipping of fabricated dowel baskets, and allows assembly of dowel basket by construction workers as opposed to highly skilled welding shops.

In view of the foregoing, it will be appreciated that field-assembly concrete dowel baskets represent a significant improvement in concrete construction and, more particularly, in concrete road construction. The foregoing relates only to the exemplary embodiments of the present invention, and that numerous changes may be made therein without departing from the spirit and scope of the invention as defined by the following claims.

DETAILED DESCRIPTION

Figure 1:
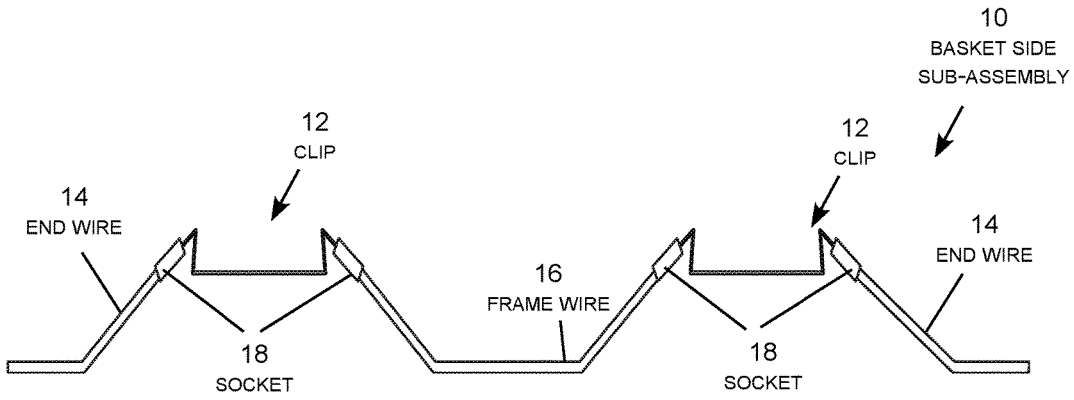
FIG. 1 is a side view of a basket side for a field-assembly concrete dowel basket assembled from clips and wire segments.

Embodiments of the invention may be realized in a field-assembly dowel basket, components for a field-assembly dowel basket, a method for constructing a concrete road or other structure using field-assembly dowel baskets, and a road or other structure constructed with field-assembly dowel baskets. Rather than the conventional approach of fabricating dowel baskets at welding shops and transporting the fabricated dowel baskets to the construction site, embodiments of the present invention provide field-assembly dowel baskets assembled at the construction site from a small number of standard components.

The field-assembly dowel basket uses clips to removably hold the dowels in place within a basket frame constructed from the clips, wire segments and connectors. The dowels, clips, wire segments and connectors can therefore be transported to the construction unassembled, where they are stored in bulk and assembled in the field on an as-needed, where needed basis. Once assembled, the dowel basket is positioned at the edge of a first concrete slab prior to pouring the slab. The dowel basket holds the dowels in place about midway up the thickness of the slab. A concrete form is positioned around the dowels near the centerline of the dowel basket. The first slab is poured so that about half of the dowels extend into the slab and half extend beyond the slab. After the first slap sets, the form is removed and a second slab is poured over the portions of the dowels that extending beyond the first slab. An expansion joint is formed or cut over the dowel basket at the intersection of the two slabs.

In an illustrative embodiment, each field-assembly dowel basket is formed from a number of basket web assemblies that each removably hold two dowels in place. Any number of basket web assemblies can be connected together with "T" clips to form a dowel basket of desired length, which typically extends laterally across the road under construction. Each basket web assembly includes two basket side sub-assemblies spaced apart from each other by the T" clips and shipping wires. Each side assembly includes two clips and wire segments that removably attach to the clips. The wire segments in each side assembly include two end wires and a frame wire that connects the clips together. Each clip includes two integral sockets built into the clip. Alternatively, separate sockets may removably attach to the clips the wire segments. For example, integral sockets made from bent sheet metal can be formed into sheet metal clips, while separate plastic sockets may be utilized with wire frame clips.

Different types of clips may be provided to receive different types of dowels, such as bar dowels and plate dowels. In alternative embodiments, the clips may support the dowels from above or below. In a particular embodiment, the plate dowel may itself be a sub-assembly formed from steel slats and one or more plastic separators. This configuration provides the plate dowel with some "give" allowing the concrete slabs connected by the dowel to laterally shift slightly with respect to each other without cracking. An illustrative dowel includes two slats and a separator.

In an embodiment, the standardized components include dowels, clips with integral sockets, end wires, frame wires, and "T" connectors. As an option, separate sockets may be provided with wire frame clips or other types of clips that do not include integral sockets. The clips may be manufactured from steel, wire, plastic such as Propylene, PVC or Nylon, or any other suitable material. In a particular embodiment, the clips may be made from sheet metal, such as 24-gauge cold rolled mild or spring steel, with sockets integrally formed by bending the sheet metal to form the sockets. Wire frame clips are also suitable, which may be bent and welded in bulk. The wire segments and wire frame clips (when used) may be manufactured from the type of steel wire typically used in wire mesh for concrete reinforcement. The "T" connectors, separate sockets (when used), and dowel separators may be made from a suitable inexpensive plastic such as Propylene, PVC or Nylon.

While specific dimensions may vary as a matter of design choice, the following dimensions are typical for an illustrative embodiment. The plate dowels are typically 12 inches long, 2 to 2.5 inches wide, and ¼ to ½ inch thick. The bar plate dowels are typically 15 to 18 inches long and ⅜ to ¾ inch in diameter. The dowel-to-dowel spacing is typically 18 to 24 inches. The side-to-side spacing the basket frame is typically 12 inches. The basket frame typically supports the dowels midway in the slab to be poured (e.g., 4 inches for 8 inch thick slab) above the base where the concrete is to be poured. The clips may be ¾ to 1.5 inches wide and made from 12 to 18 gauge sheet metal, such as spring steel. The wire components may be made from ¼ to ⅜ inch diameter concrete reinforcement steel wire. The plastic components may be made from any suitable plastic, such as Polypropylene, PVC, Nylon, or many other options.

Figure 2:
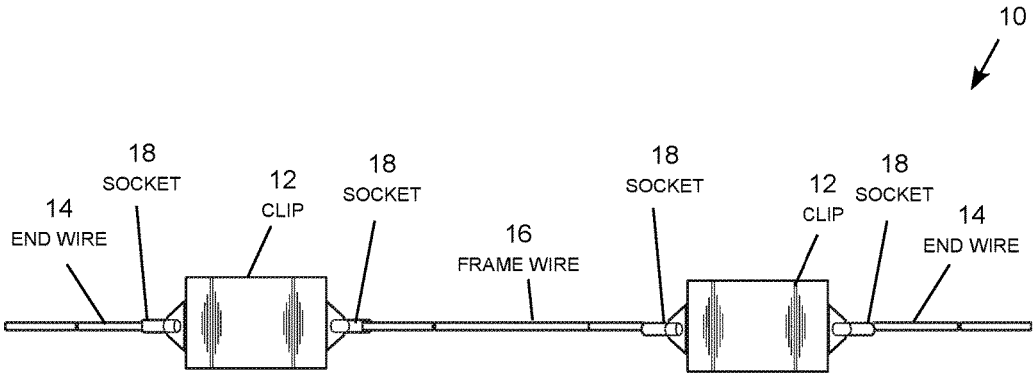
FIG. 2 is a top view of the basket side sub-assembly.

FIG. 1 is a side view of a basket side sub-assembly 10 for a field-assembly concrete dowel basket assembled from steel clips, steel wire segments, and in some embodiments plastic connectors. FIG. 2 is a top view of the basket side sub-assembly 10. The side basket side sub-assembly 10 is assembled from two clips 12, two end wires 14, and a frame wire 16 that connects the clips together. The clips 12, end wires 14, and frame wire 16 are removably attached components configured for field assembly on an as-needed, where-needed basis. Each clip includes two sockets 18 that removably receive the wire components. The sockets 18 may be integrally built into the clips or they may be separate components. The clips 12, end wires 14, and frame wire 16 are typically steel components, while the sockets 18 may be integral steel parts of the clips or separate plastic components.

Figure 3:
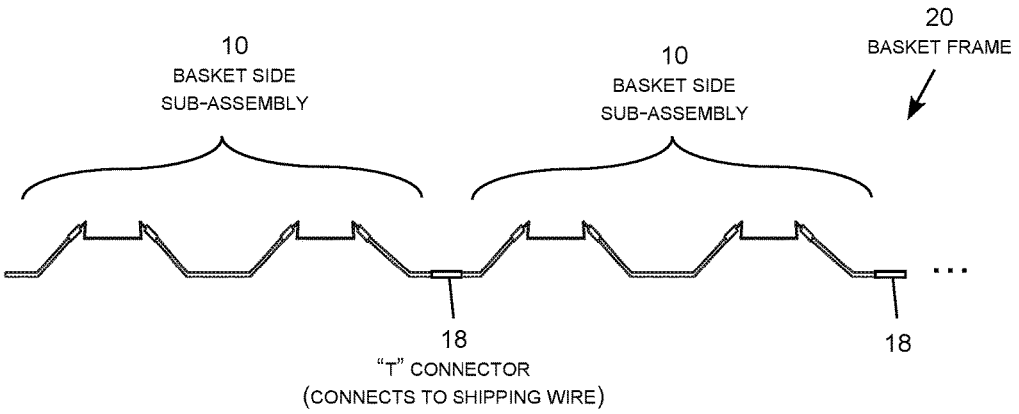
FIG. 3 is a side view of a basket frame assembled from a number of basket side sub-assemblies.
Figure 4:
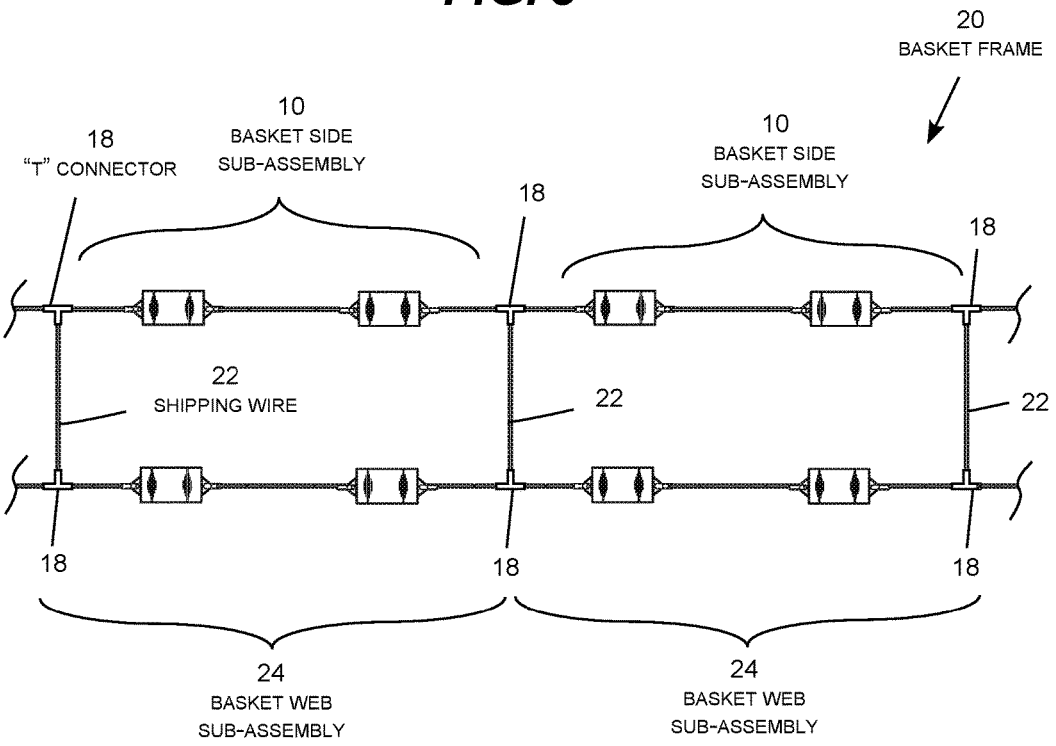
FIG. 4 is a top view of the basket frame.

FIG. 3 is a side view of a basket frame 20 assembled from a number of basket side sub-assemblies 10. The basket side sub-assemblies 10 are connected to each other with "T" connectors 18 to form a chain of desired length. FIG. 4 is a top view of the basket frame 20 showing that the "T" connectors 18 removably attach to shipping wires 22 that connect a pair of basket side assemblies together to form basket web sections 24. Each basket web section 24 includes two opposing basket side sub-assemblies 10 spaced apart by the shipping wires 22 with pairs of clips 12 aligned to receive dowels.

Figure 5:
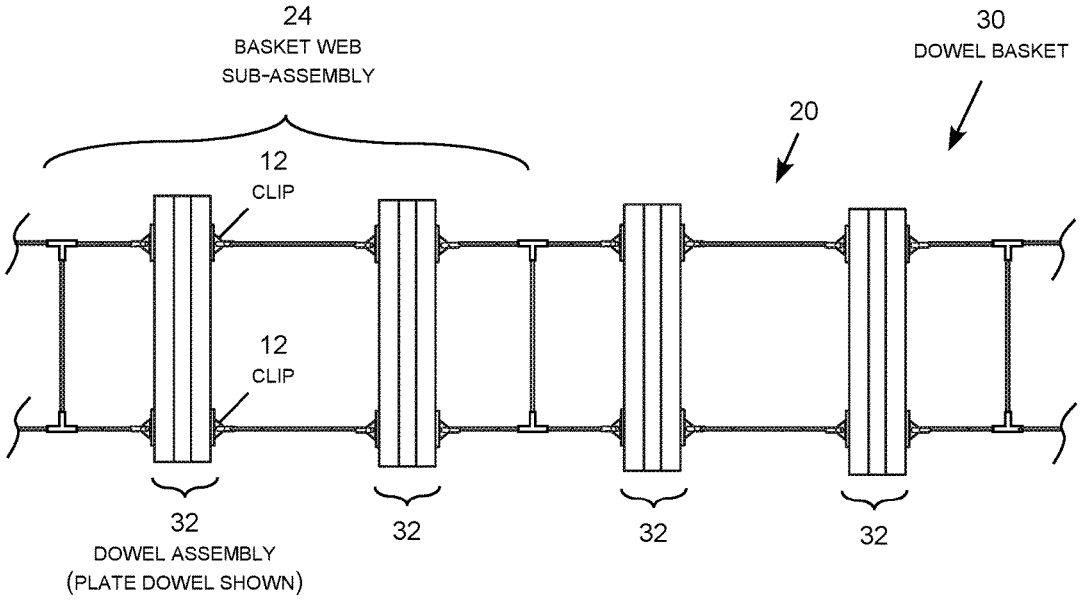
FIG. 5 is a top view of a field-assembly dowel basket assembled from the basket frame and removable dowels.
Figure 6:
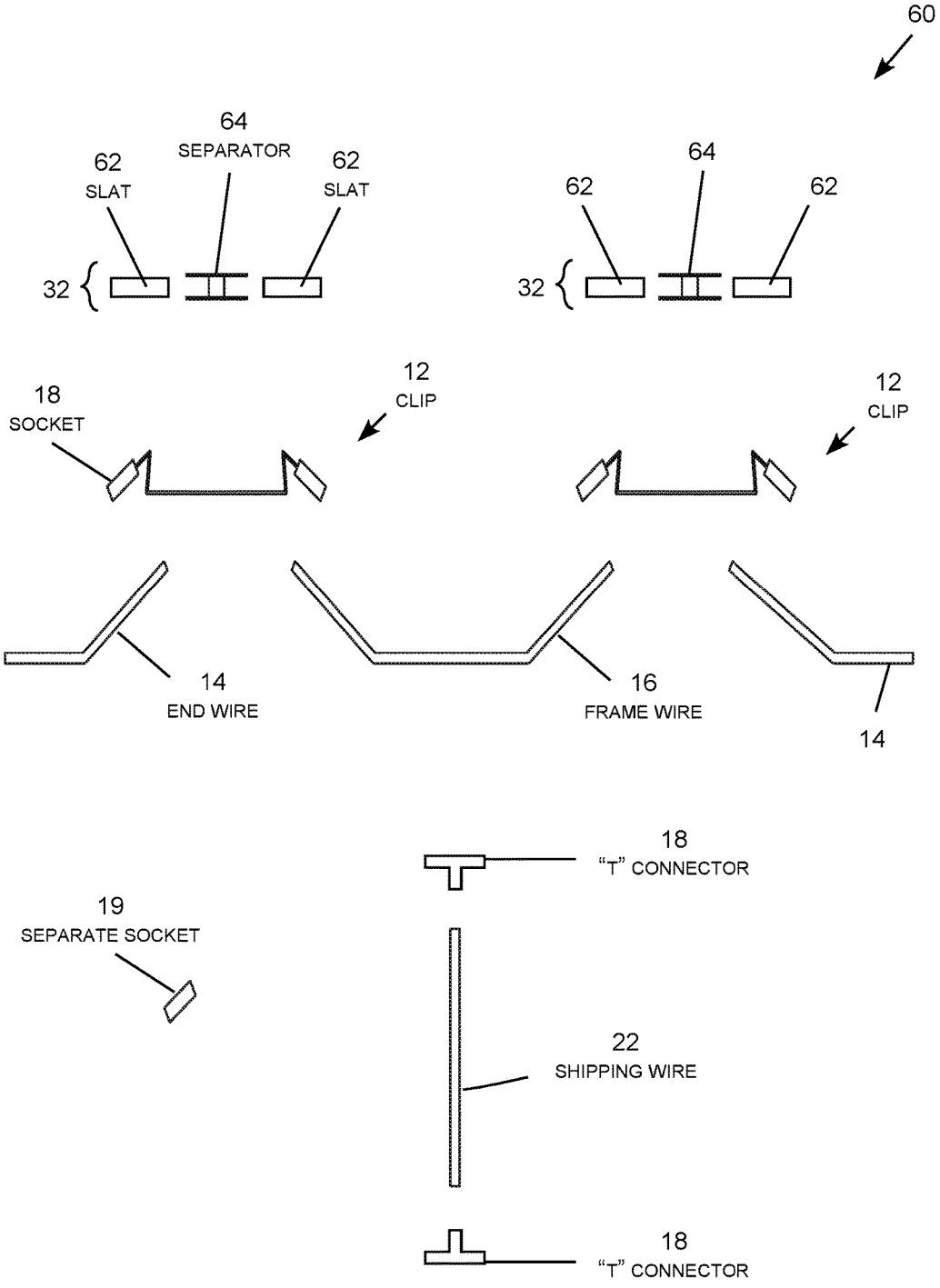
FIG. 6 is a disassembled view of the components of the field-assembly dowel basket.

FIG. 5 is a top view of a field-assembly dowel basket 30 assembled from the basket frame 20 and removable dowels 32. FIG. 6 is a disassembled view of the components of the field-assembly dowel basket 20. The basket frame 20 consists of a chain of basket web section 24 removably connects to each other with "T" connectors 18. This example shows plate dowels, which snap into the clips. The clips are sufficiently resilient and sized to hold the dowels securely in place by interference fit. Dowel baskets with clips that support the dowels from above may be easier to load with dowels after the basket frame has been placed on the ground, but present a higher risk of knocking the dowels loose. For dowels supported by the clips from above, the interference fit should be sufficiently tight to prevent the dowels from being knocked loose from the clips when the concrete is poured over dowel basket. A strap or detent mechanism may be added if desired. Supporting the dowel from below avoids this concern, while also allowing workers to step or walk on the dowel basket without knocking the dowels loose.

Figure 7:
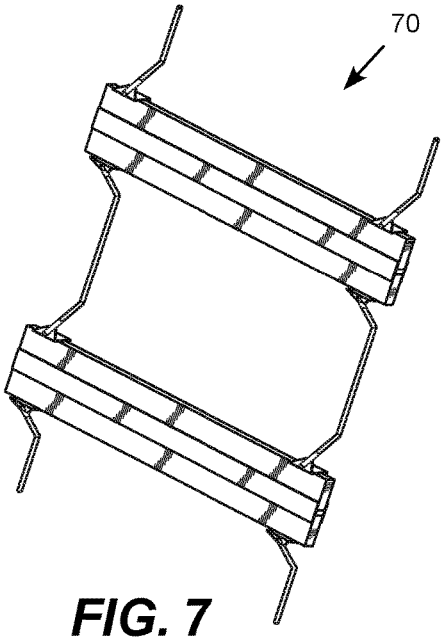
FIG. 7 is a perspective view a basket web assembly with clips that support plate dowels from below.
Figure 9:
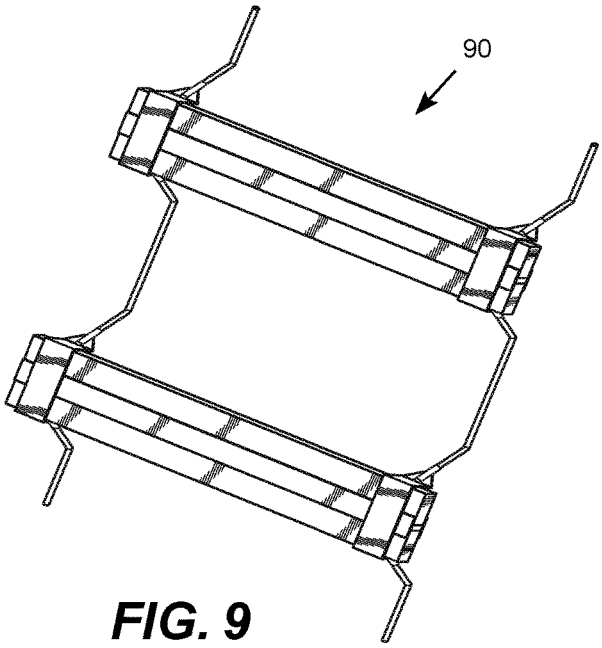
FIG. 9 is a perspective view a basket web assembly with clips that support plate dowels from above.
Figure 8:
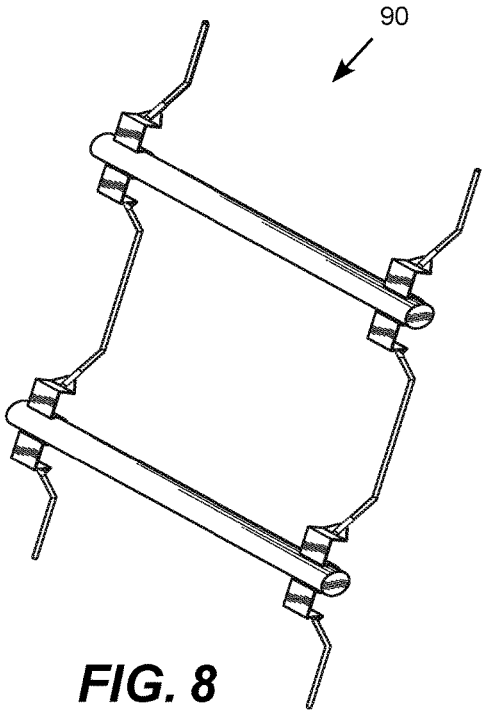
FIG. 8 is a perspective view a basket web assembly with clips that support bar dowels from below.
Figure 10:
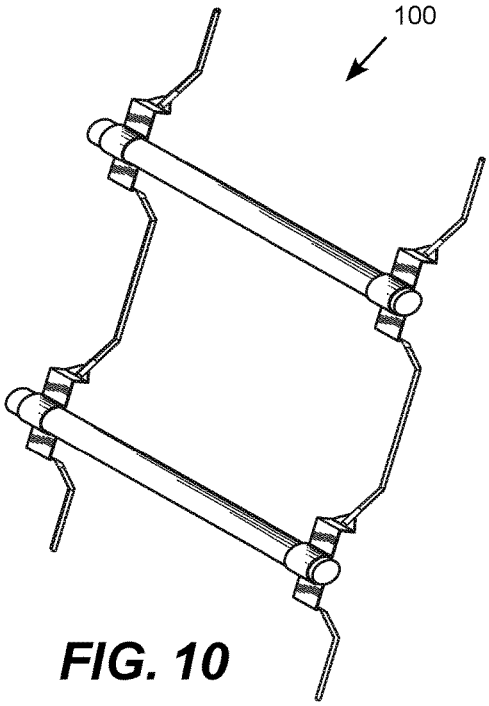
FIG. 10 is a perspective view a basket web assembly with clips that support bar dowels from above.
Figure 11:
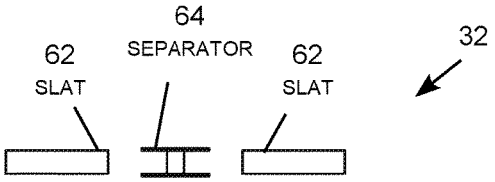
FIG. 11 is an assembly end view of a plate dowel sub-assembly.
Figure 13:
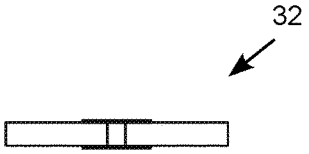
FIG. 13 is an assembled end view of a plate dowel sub-assembly.
Figure 12:
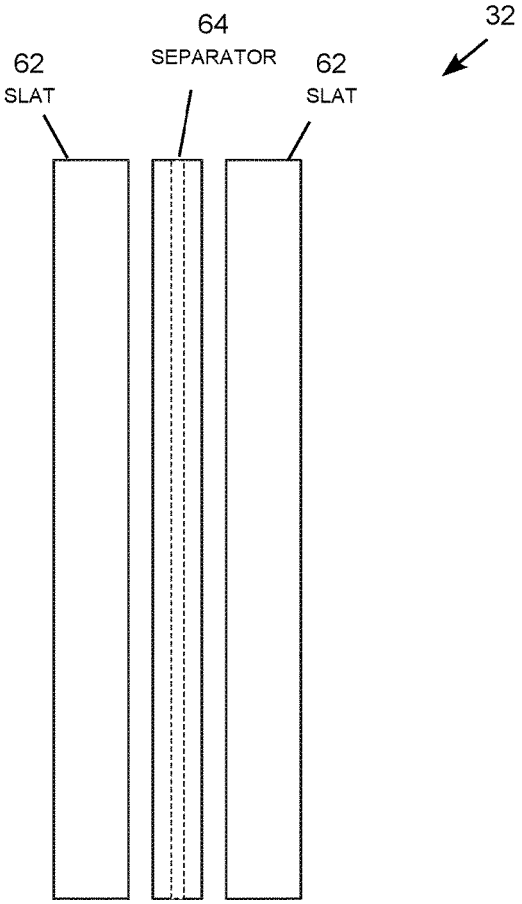
FIG. 12 is an assembly top view of a plate dowel sub-assembly.
Figure 14:
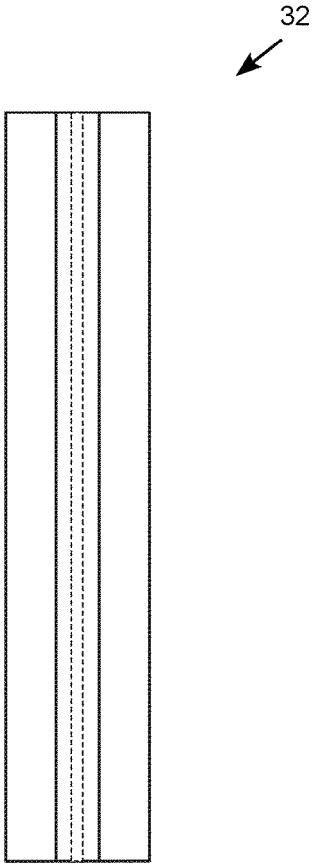
FIG. 14 is an assembled top view of a plate dowel sub-assembly.

The clips of the basket frame may be configured to receive bar dowels or plate dowels, which the clips may support from above or below. FIG. 7 is a perspective view of a basket web assembly 70 with clips that support plate dowels from below. FIG. 8 is a perspective view a basket web assembly 80 with clips that support bar dowels from below. FIG. 9 is a perspective view a basket web assembly 90 with clips that support plate dowels from above. FIG. 10 is a perspective view a basket web assembly 100 with clips that support bar dowels from above.

FIGS. 11-14 show a plate dowel 32 sub-assembly. The plate dowel 32 is composed of slats 62 and a separator 64 configured for field assembly on an as-needed, where-needed basis. The slats 62 are typically made of steel and the separator 64 made of plastic.

Figure 15:
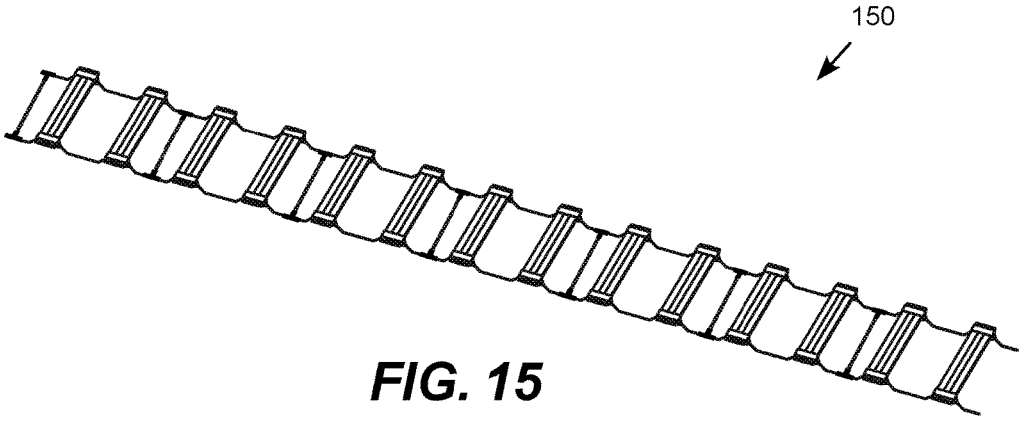
FIG. 15 is a perspective view of an elongated section of a field-assembly dowel basket with plate dowels.
Figure 16:
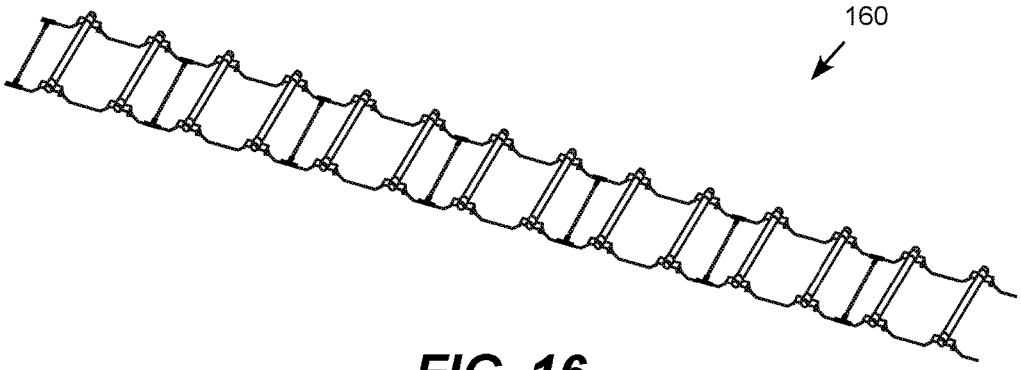
FIG. 16 is a perspective view of an elongated section of a field-assembly dowel basket with bar dowels.
Figure 17:
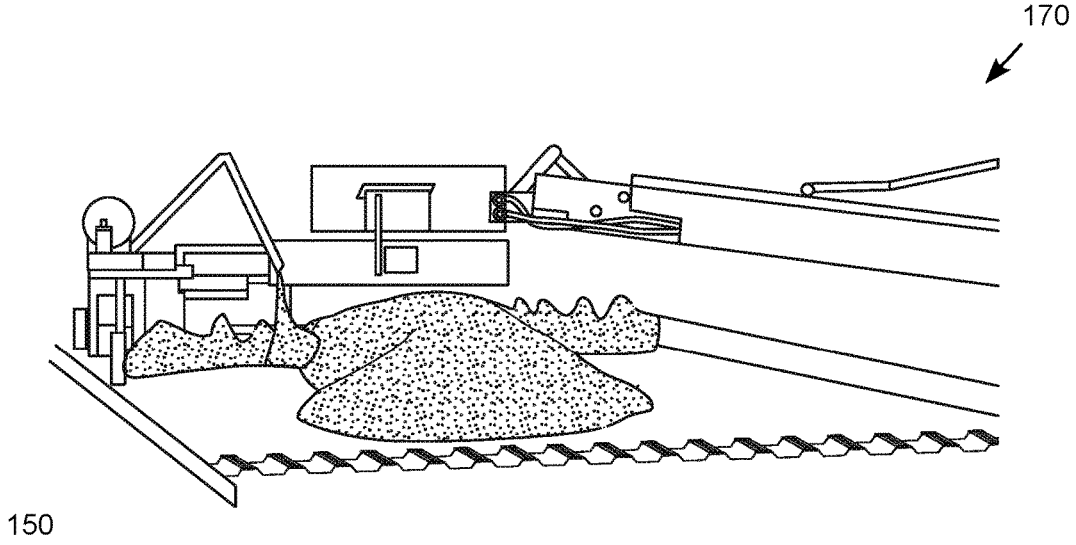
FIG. 17 is a perspective view of concrete road formation using field-assembly dowel baskets.

FIG. 15 is a perspective view of an elongated section of a field-assembly dowel basket 150 with plate dowels. FIG. 16 is a perspective view of an elongated section of a field-assembly dowel basket 160 with bar dowels. FIG. 17 is a perspective view of concrete road formation using the field-assembly dowel basket 150 with plate dowels. The concrete forms are not shown to avoid cluttering the figure.

Figure 18:
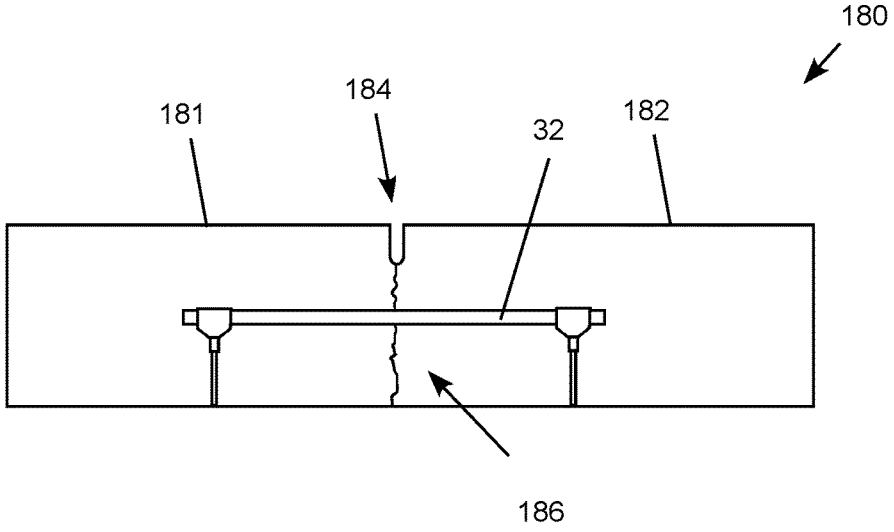
FIG. 18 is a cross-section view of a field-assembly dowel basket spanning an expansion joint between adjacent concrete slabs.

FIG. 18 is a cross-section view of a field-assembly dowel basket 180 spanning an expansion joint between adjacent concrete slabs. A plate dowel 32 spans the joint between the concrete slabs 181 and 182. An expansion joint 184 is created above the dowel 32, typically by inserting a wood slat or other form into the poured concrete before it sets or cutting the joint into the concrete after it has set. The expansion joint 184 facilitates formation of a crack 186 below the joint at the intersection between the slabs, which allows slight lateral movement of the slabs with respect to each other to accommodate thermal expansion and settling. The plastic separator in the dowel 32 allows the dowel to "give" a bit to accommodate slight this relative slab movement to reduce cracking of the concrete.

Figure 19:
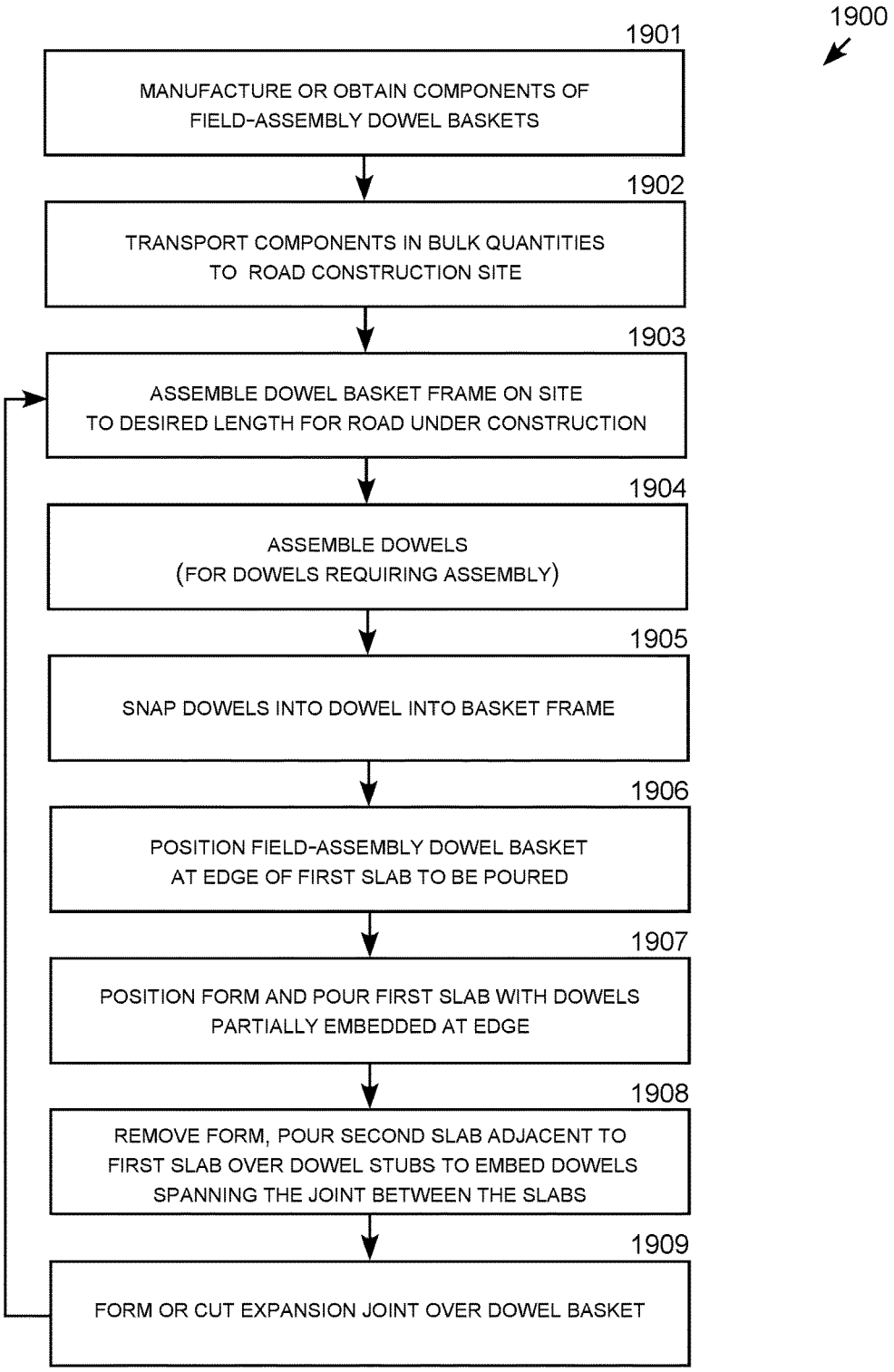
FIG. 19 is a logic flow diagram for constructing a concrete road using the field-assembly dowel baskets.
Figure 20:
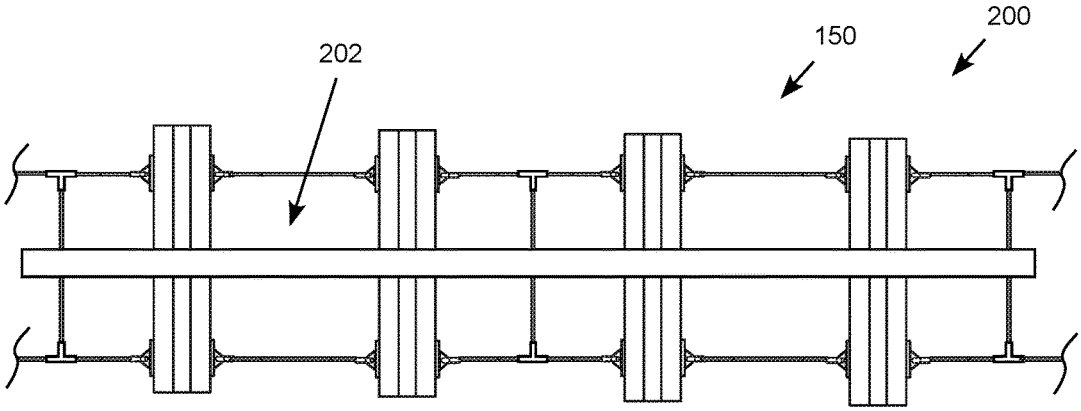
FIG. 20 is a top view of a dowel basket and concrete form.
Figure 21:
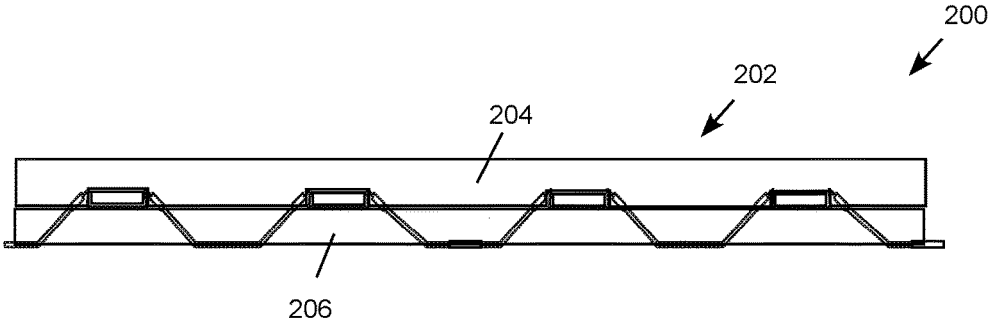
FIG. 21 is a side view of the dowel basket and concrete form.
Figure 22:
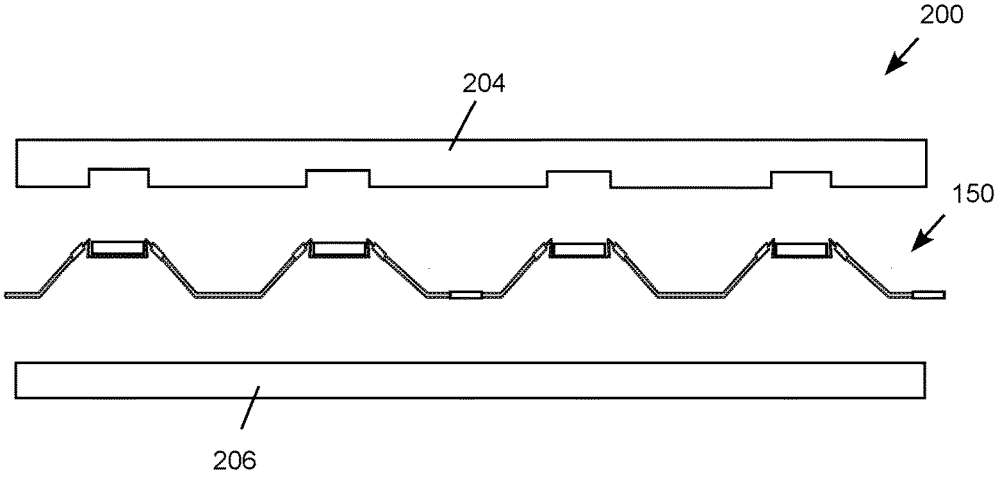
FIG. 22 is an assembly side view of the dowel basket and concrete form.

FIG.19 is a logic flow diagram 1900 for constructing a concrete road using the field-assembly dowel baskets. FIGS. 20-22 illustrate the use of concrete forms described in FIG. 19. In step 1901, the components of the field-assembly dowel basket are manufactured at suitable locations away from the road construction site where they are to be used. Alternatively, the components may be obtained from one or more component suppliers. Step 1901 is followed by step 1902, in which the components are transported in bulk quantities to the road construction site. Step 1902 is followed by step 1903, in which a dowel basket is assembled from the components at the construction site on an as-needed, where-needed basis. For jobs using multi-part dowels, step 1903 is followed by step 1904 in which the dowels are assembled at the construction site on an as-needed, where-needed basis. Step 1904 is followed by step 1905, in which the dowels are snapped into place into the basket frame. Step 1905 is followed by step 1906, in which the assembled dowel basket is positioned at the edge of a first slab to be poured.

Step 1906 is followed by step 1907, in which a form is positioned around the dowel basket, as illustrated by the dowel basket and form assembly 200 shown in FIGS. 20-22, and the first concrete slab is poured. In this example, a form 202 is positioned approximately along the center line of the dowel basket 150. The form 202 includes a bottom rail 204 and a top rail 206 with notches cut to fit the dowels. The top and bottom rails meet to create a wall around dowels sufficiently tight to hold back the concrete to be poured. The rails may be made from lumber, plywood, plastic, steel or other suitable materials. Standardized form sections of may be provided along with the dowel basket components to facilitate construction site provisioning and inventory management. For example, reusable plastic or metal forms in standard lengths (e.g., 2 feet, 4 feet, 8 feet) for slabs of standard thickness (e.g., 6 inch, 8, inch, 10 inch) may be available to facilitate construction and minimize the time and waste associated with ad hoc lumber forms.

After the first concrete slab has set sufficiently, step 1907 is followed by step 1908, in which the form is removed and a second concrete slab is poured over the dowel stubs extending from the first slab. Step 1908 is followed by step 1909, in which an expansion joint is formed or cut into the joint between the slabs above the dowel basket.

Although the field-assembly dowel baskets have been illustrated in the context of horizontal road pavement, it will be appreciated that the dowel basket is well adapted for but not limited to the road construction application and can be used for any concrete joint of sufficient size regardless of its intended purpose or orientation. For example, the invention is equally applicable to joints in concrete sidewalks, building floors, walls, ceilings, abutments and other structures. Those skilled in the art will appreciate that the foregoing describes preferred embodiments of the invention and that many adjustments and alterations will be apparent to those skilled in the art within the spirit and scope of the invention as defined by the appended claims.

The invention claimed is:

1. An unassembled field-assembly dowel basket for concrete construction configured for assembly into a dowel basket on an as-needed, where-needed basis, comprising:

a plurality of dowels;

a plurality of clips, each clip configured to removably support one of the dowels, each clip further configured to removably receive wire segments;

the wire segments including a plurality of end wires and a plurality of frame wires;

a plurality of "T" connectors removably attachable to the end wires and a plurality shipping wires;

the shipping wires configured to space apart basket sides assembled from the clips and wire segments to position pairs of clips such that each pair of clips supports an associated dowel.

2. The field-assembly dowel basket of claim 1, wherein the dowels are a bar dowels.

3. The field-assembly dowel basket of claim 1, wherein the dowels are a plate dowels.

4. The field-assembly dowel basket of claim 3, wherein each plate dowel is a sub-assembly comprising a pair of slats and a separator configured to removably support the slats.

5. The field-assembly dowel basket of claim 1, further comprising sockets for receiving the wire segments integrally formed as part of the clips.

6. The field-assembly dowel basket of claim 1, further comprising sockets that removably attach to the clips and removably attach to the wire segments.

7. The field-assembly dowel basket of claim 1, wherein the clips are configured to support the dowels from above.

8. The field-assembly dowel basket of claim 1, wherein the clips are configured to support the dowels from below.

9. An assembled field-assembly dowel basket for concrete construction, comprising:

a plurality of basket side sections, wherein basket each side section comprises two clips, two end wires, and one frame wire connecting the clips together, wherein the clips are removably attached to the end wires and the frame wire;

a plurality of basket web sections, wherein each basket web sections comprises two basket side sections, a "T" connector removably attached to each basket side section, and a shipping wire removably attached to the T" connector spacing;

wherein the shipping wire and "T" connectors space the basket sides apart and position pairs of clips such that each pair of clips supports an associated dowel;

wherein the "T" connectors removably attach the basket web sections to each other to form dowel basket comprising a chain of basket web sections.

10. The field-assembly dowel basket of claim 9, wherein the dowels are a bar dowels.

11. The field-assembly dowel basket of claim 9, wherein the dowels are a plate dowels.

12. The field-assembly dowel basket of claim 11, wherein each plate dowel is a sub-assembly comprising a pair of slats and a separator configured to removably support the slats.

13. The field-assembly dowel basket of claim 9, further comprising sockets for receiving the wire segments integrally formed as part of the clips.

14. The field-assembly dowel basket of claim 9, further comprising sockets that removably attach to the clips and removably attach to the wire segments.

15. The field-assembly dowel basket of claim 9, wherein the clips are configured to support the dowels from above.

16. The field-assembly dowel basket of claim 9, wherein the clips are configured to support the dowels from below.

17. A method for constructing a concrete road at a road construction site, comprising manufacturing or obtaining components of field-assembly dowel baskets;

transporting the components in bulk quantities to the construction site;

assembling a dowel basket of desired length from the components at the construction site;

positioning the dowel basket at the edge of a first concrete slab to be poured;

positioning a concrete form around dowels of the dowel basket, wherein the form comprises notches configured to accommodate the dowels;

pouring the first concrete slab so that a first portion of each dowel is embedded in the first slab and a second portion of each dowel extends from the first slab; and after the first slab sets, removing the form and pouring a second concrete slab adjacent to the first concrete slab over the second portions of the dowels so that the dowels span a joint between the first and second concrete slabs;

and assembling each field-assembly dowel basket from removably attachable components, comprising:

a plurality of dowels;

a plurality of clips, each clip configured to removably support one of the dowels, each clip further configured to removably receive wire segments; the wire segments including a plurality of end wires and a plurality of frame wires;

and a plurality of "T" connectors removably attachable to the end wires and a plurality shipping wires; wherein the shipping wires are configured to space apart basket sides assembled from the clips and wire segments to position pairs of clips such that each pair of clips supports an associated dowel.

18. The method of claim 17, further comprising forming or cutting an expansion joint above the dowels at the joint between the first and second concrete slabs.

19. The method of claim 17, further comprising assembling each dowel from a pair of slats and a separator.

* * * * *